US006427938B1

(12) United States Patent
Madrzak et al.

(10) Patent No.: US 6,427,938 B1
(45) Date of Patent: Aug. 6, 2002

(54) PROCESS AND APPARATUS FOR CUTTING A RUNNING MATERIAL WEB

(75) Inventors: Zygmunt Madrzak, Heidenheim; Walter Kaipf, Haunsheim; Roland Möller, Herbrechtingen; Matthias Wohlfahrt, Heidenheim; Jörg Maurer, Steinheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/421,874

(22) Filed: Oct. 21, 1999

(30) Foreign Application Priority Data

Oct. 22, 1998 (DE) ..... 198 48 810
Sep. 17, 1999 (DE) ..... 199 44 704

(51) Int. Cl.[7] ..... B65H 35/08
(52) U.S. Cl. ..... 242/526.3
(58) Field of Search ..... 242/526.3, 526, 242/532, 532.2, 541.3, 541.1, 541.4, 541.5, 541.6, 541.7, 542.3

(56) References Cited

U.S. PATENT DOCUMENTS 3,727,853 A 4/1973 Kinoshita
4,087,319 A * 5/1978 Linkletter
4,196,865 A * 4/1980 Patriksson
4,326,680 A * 4/1982 Tetro et al.
4,444,362 A * 4/1984 Karr
4,445,646 A * 5/1984 Karr et al.
4,546,930 A * 10/1985 Rohde et al.
5,314,132 A * 5/1994 Ando et al.
5,360,179 A 11/1994 Vesterinen et al.
5,377,930 A * 1/1995 Noyes
5,531,396 A 7/1996 Kinnunen et al.
5,620,151 A * 4/1997 Ueyama et al.
5,895,007 A * 4/1999 Moller et al.
5,918,830 A * 7/1999 Verajankorva et al.
5,967,449 A * 10/1999 Thomas et al.
5,988,557 A * 11/1999 Moller et al.
6,129,305 A * 10/2000 Moller et al.
6,270,334 B1 * 8/2001 Cozian

FOREIGN PATENT DOCUMENTS

DE 2010072 9/1971
DE 1774101 11/1971

(List continued on next page.)

OTHER PUBLICATIONS

Patent Abstract of Japan 7291494, published Nov. 7, 1995.
Patent Abstract of Japan 10175759, published Jun. 30, 1998.

*Primary Examiner*—William A. Rivera
(74) *Attorney, Agent, or Firm*—Greenblum & Bernstein, P.L.C.

(57) ABSTRACT

Process and apparatus for cutting a running material web in which the material web is wound onto several winding cores in succession, such that winding of the material web onto a new winding core begins after a predetermined diameter has been attained in a wound roll formed on an old winding core. The process includes moving the new winding core between a winding roll and the wound roll, such that the material web is fed onto the wound roll from the winding roll. The process further includes forming a nip between the new winding core and the winding roll, positioning at least one cutting device one of in a region between the wound roll and the nip and in a region upstream of the winding roll relative to a web run direction, and moving the at least one cutting device relative to the material web in a plane substantially parallel to the material web. In this manner, the running material web can be completely cut. The apparatus includes at least one cutting device adapted to completely cut the material web, and the at least one cutting device can be mounted for movement relative to the material web in a plane substantially parallel to the material web.

59 Claims, 7 Drawing Sheets

FOREIGN PATENT DOCUMENTS

| | | |
|---|---|---|
| DE | 2721883 | 11/1978 |
| DE | 2752648 | 5/1979 |
| DE | 3125553 | 1/1993 |
| DE | 9305248 | 7/1993 |
| DE | 4401804 | 6/1994 |
| DE | 4415316 | 11/1995 |
| DE | 19710282 | 9/1998 |
| EP | 658504 | 6/1995 |
| WO | 97/48632 | 12/1997 |

* cited by examiner

PROCESS AND APPARATUS FOR CUTTING A RUNNING MATERIAL WEB

CROSS-REFERENCE TO RELATED APPLICATIONS

The present application claims priority under 35 U.S.C. § 119 of German Patent Application No. 198 48 810.6, filed on Oct. 22, 1998 and German Patent Application No. 199 44 704.7, filed on Sep. 17, 1999, the disclosures of which are expressly incorporated by reference herein in their entireties.

BACKGROUND OF THE INVENTION

1. Field of the Invention

The present invention relates to a process for separating a running material web, e.g., a paper web, in which the material web is wound sequentially onto several winding cores, e.g., reel-spools, and initiating winding onto a new winding core each time a wound roll formed on a previous old winding core has reached a predetermined diameter. The new winding core is guided between a winding roll, e.g., a king roll, and the old winding core, which continues to be fed via the winding roll, and the running material web is cut or separated in a region between the wound roll formed on the old winding core and a nip formed by the winding roll and the new winding core.

The present invention further relates to a device for performing such a process with at least one cutting device.

2. Discussion of Background Information

Cutting (separation) processes and devices, such as those generally described above, are used in paper manufacturing, for example, to wind the finished paper web onto several winding cores, also referred to as reel-spools, one after the other without interrupting the manufacturing process, i.e., without turning off the paper machine.

In such a process, it must be ensured that the new web end, which is formed by cutting or separating the material web, is guided to the new winding core to form a new wound roll.

International Publication No. WO 97/48632, U.S. Pat. No. 5,360,179, and European Publication EP 0 658 504 B1 disclose cutting the paper web before the winding nip, which is formed between the winding roll and the new winding core, and providing either curved cutting lines or cutting lines that run diagonally to the direction of web travel. However, when the paper web is cut before the winding nip, there is a danger that the new web end will recoil and not be able to be guided into the winding nip.

Further, it has been disclosed to strike the paper web with a swinging separating device running along the width of the machine placed between the new and old winding cores, i.e., behind the winding nip. The ensuing cut edge that runs perpendicular to the direction of web travel can lead to problems in winding the new web end onto the new winding core.

Also, European Publication No. EP 0 658 504 B1 discloses separating the material web behind the winding nip, which is formed between the winding roll and the new winding core, but it is not mentioned how this occurs.

German Publication No. DE 44 01 804 A1 discloses moving a separating device, which includes a sectionally traversing knife as a separating mechanism, into the path of a paper web. It is further known from this publication to weaken the paper web only at one point with a knife and subsequently to separate it using pressurized air. However, using only the sectionally traversing knife or a knife that only weakens the paper web carries the danger of uncontrolled tearing of the paper web.

SUMMARY OF THE INVENTION

The present invention provides a process and a device of the type generally discussed above that allows an optimal initial winding of the new web end onto the new winding core.

Therefore, the invention provides for completely cutting (separating) the material web with at least one cutting device that is movable relative to the material web in a plane substantially parallel to the material web.

Moreover, the instant invention provides for cutting the material web in a vicinity of a winding roll, e.g., in a region between the winding roll and the wound roll or in a region upstream, relative to a web travel direction, from the winding roll.

Complete cutting or separation of the material web, according to the present invention, prevents an undefined tearing of the material web so that the leading edge of the new web end always has the same definable form. Moreover, the leading edge can be guided onto the new winding core in a defined manner. Further, the necessity of applying pressurized air to the material web for complete separation of the material web can be dispensed with.

According to an exemplary embodiment of the invention, the cutting device moves at an at least approximately constant speed and across, e.g., at least essentially perpendicular, to the direction of web travel.

In this manner, a cutting line can be produced in the material web that runs diagonally to the travel direction of the material web from one edge of the material web to its opposite edge. The diagonal edge of the new web end produced in this manner can be wound onto the new winding core in a relatively problem-free manner even under very high web speeds, and produces a conically wound initial winding.

According to a further embodiment of the invention, two cutting devices can be moved in opposite directions across, e.g., at least essentially perpendicular to, the direction of web travel and can preferably be moved at an at least approximately constant speed.

In relation to the cross-direction, the two cutting devices can be placed against the material web in the region of its center or its ends in such a way that two intersecting cutting lines ensue, both of which run diagonally to the web travel direction and either from the center to the edges or vice versa. In this manner, the leading edge of the new web end can be cut in a pointed fashion such that the initial winding onto the new winding core is simplified.

The present invention further provides a device for performing the process according to the instant invention, and includes at least one cutting device structured and arranged for completely separating the material web.

Accordingly, the present invention relates to a process for cutting a running material web in which the material web is wound onto several winding cores in succession, such that winding of the material web onto a new winding core begins after a predetermined diameter has been attained in a wound roll formed on an old winding core. The process includes moving the new winding core between a winding roll and the wound roll, such that the material web is fed onto the wound roll from the winding roll. The process further includes forming a nip between the new winding core and the winding roll, positioning at least one cutting device one of in a region between the wound roll and the nip and in a region upstream of the winding roll relative to a web run direction, and moving the at least one cutting device relative to the material web in a plane substantially parallel to the material web. In this manner, the running material web can be completely cut.

In accordance with another feature of the instant invention, the moving of the at least one cutting device may include moving the at least one cutting device across a web travel direction. In this manner, a diagonal cutting line results. The at least one cutting device can be moved substantially perpendicular to the web travel direction.

According to another feature of the invention, the moving of the at least one cutting device can include moving the at least one cutting device diagonally to a web travel direction. The diagonal movement can include a component parallel to and opposite the web travel direction. Alternatively, the diagonal movement can include a component parallel to and in the web travel direction.

In accordance with a further feature of the present invention, the moving of the at least one cutting device can include moving the at least one cutting device continuously across an entire width of the material web.

In accordance with another feature of the invention, the moving of the at least one cutting device may include moving the at least one cutting device at an at least approximately constant speed. The at least approximately constant speed can be between approximately 10 and 40 m/s.

According to another feature of the present invention, the process can further include accelerating the cutting device before cutting the material web.

According to still another feature of the invention, the at least one cutting device can include at least one of a knife, a rotating toothed cutting wheel, a laser, and a jet emitting a stream of water.

In accordance with a further feature of the present invention, the at least one cutting device may include at least two cutting devices, and the process can further include moving the at least two cutting devices in opposite directions across a web travel direction at an at least approximately constant speed. The at least two cutting devices can be moved substantially perpendicular to the web travel direction. Further, the at least two cutting devices can be located in positions separated in the web travel direction, and each of the at least two cutting devices can be approximately centered relative to a cross-wise direction. Moreover, the process can further include moving the at least two cutting devices from respective edges of the material web toward a middle of the web, or moving the at least two cutting devices from a middle of the material web toward respective edges of the web.

According to still another feature of the invention, the at least one cutting device may include at least two cutting devices, and the process can further include moving the at least two cutting devices relative to the material web in a plane that is substantially parallel to the material web.

According to a further feature of the present invention, the process may further include cutting the material web in a region of a free draw between the new winding core and the wound roll.

In accordance with another feature of the instant invention, the process may further include cutting the material web in a region in contact with the new winding core.

In accordance with a still further feature of the invention, during the cutting of the material web, the rotational axis of the new winding core can lie above a horizontal plane containing the rotational axis of the old winding core. Alternatively, during the cutting of the material web, the rotational axis of the new winding core can lie essentially in a horizontal plane containing the rotational axis of the old winding core.

According to a still further feature of the present invention, the cutting forms a new web end, and the process may further include applying the new web end to the new winding core. The applying of the new web end to the new winding core may include at least one of blowing, moistening, gluing, and providing strips of adhesive.

In accordance with another feature of the invention, the travel speed of the material web is not reduced during the cutting of the material web.

In accordance with a further feature of the instant invention, the new winding core may be inserted into the material web when the new winding core is moved between the winding roll and the wound roll.

According to still another feature of the invention, the material web can include a paper web, the winding cores may be composed of reel spools, and the winding roll can be composed of a king roll.

In accordance with yet another feature of the instant invention, the moving of the at least one cutting device may include moving the at least one cutting device across a web travel direction, whereby a diagonal cutting line results, and the moving of the at least one cutting device can include moving the at least one cutting device at an at least approximately constant speed. The at least one cutting device may include at least one of a knife, a rotating toothed cutting wheel, a laser, and a jet emitting a stream of water. Further, the at least one cutting device can include at least two cutting devices and the process may further include moving the at least two cutting devices in opposite directions during the cutting of the material web.

According to a further of the invention, the process can include cutting the paper web in a free run region between the wound roll and the new winding core.

According to another feature of the instant invention, the process can include cutting the paper web in a region between the wound roll and the nip.

In accordance with still another feature of the present invention, the process can further include cutting the paper web in a region upstream from the winding roll. Further, the process can include cutting the paper web while the paper web is in contact with a roll positioned upstream from the winding roll.

The present invention is also directed to an apparatus for cutting a running material web in which the material web is wound onto several winding cores in succession. The apparatus includes at least one cutting device adapted to completely cut the material web, and the at least one cutting device can be mounted for movement relative to the material web in a plane substantially parallel to the material web.

In accordance with another feature of the present invention, the at least one cutting device may be mounted for movement across an entire width of the material web.

In accordance with still another feature of the instant invention, a transport device having at least one cylinder/piston unit can be provided, and the piston can be coupled, on one end, to the at least one cutting device.

According to a further feature of the invention, a transport device having a continuous element can be arranged to wrap around deflection rolls, and the continuous element may be coupled, on an outer side, to the at least one cutting device. The continuous element can include one of a chain and strap.

According to a still further feature of the present invention, an old winding core on which a wound roll is being wound, and a new winding core on which a next wound roll will be wound can be provided. The winding cores may include an elastically deformable covering composed of a wear-resistant plastic. The wear-resistant plastic can include polyurethane.

In accordance with still another feature of the instant invention, an old winding core on which a wound roll is being wound, a new winding core on which a next wound roll will be wound, and a winding roll can be provided. The at least one cutting device may be located between the new winding core and the wound roll. The winding cores may include a covering made of metal, and the winding roll can include a covering composed of an elastically deformable wear-resistant plastic. The wear-resistant plastic can include polyurethane.

In accordance with a further feature of the invention, the at least one cutting device may be mounted for movement across a width of the material web. The at least one cutting device can include a jet adapted to direct a water stream at a new winding core.

According to another feature of the invention, the at least one cutting device can include at least two cutting devices, and the at least two cutting devices can be separated in the web travel direction and may be mounted for movement in opposite directions across the web travel direction. The at least two cutting devices may be mounted for movement substantially perpendicular to the web travel direction.

According to a still further feature of the instant invention, the at least one cutting device can include at least two cutting devices, and the at least two cutting devices may be mounted for movement relative to the material web in a plane substantially parallel to the material web. Each of the at least two cutting devices can be composed of at least one of a knife, a water jet, a laser, and a rotating toothed cutting wheel.

In accordance with another feature of the present invention, the at least one cutting device can include at least two cutting devices, and the at least two cutting devices may be mounted for movement in opposite directions. The at least two cutting devices can be mounted for movement from respective edges of the material web to a middle of the material web. Alternatively, the at least two cutting devices may be mounted for movement from a middle of the material web to respective edges of the material web.

According to yet another feature of the present invention, the at least one cutting device may be mounted for movement across a web travel direction, whereby a diagonal cutting line results, and the at least one cutting device can include at least one of a knife, a rotating toothed cutting wheel, a laser, and a jet emitting a stream of water. The at least one cutting device may be mounted for movement at an at least approximately constant speed. The at least one cutting device can include at least two cutting devices mounted for movement in opposite directions during the cutting of the material web.

According to another feature of the instant invention, the cutting device can include a fluid jet. Further, the fluid jet can include a stream of water.

In accordance with still another feature of the invention, an old winding core on which a wound roll is being wound, and a new winding core on which a next wound roll will be wound can be provided. The cutting device may be arranged between the old winding core and the new winding core.

In accordance with yet another feature of the invention, an old winding core on which a wound roll is being wound, and a new winding core on which a next wound roll will be wound can be provided. The cutting device may be arranged upstream, relative to a web run direction, from said new winding core. Further, at least one deflection roll may be located upstream from the new winding core. Still further, the cutting device may be arranged upstream from the at least one deflection roll.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
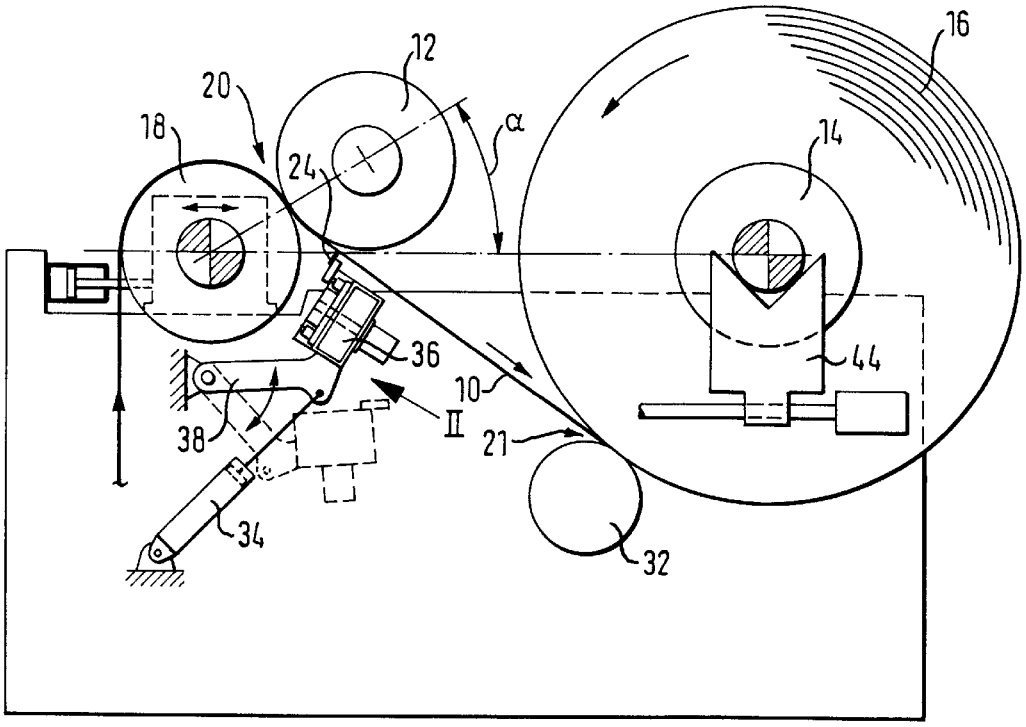
FIG. 1 illustrates a side view of a winding device according to an exemplary embodiment of the invention.

In a winding device according to FIG. 1, which is a component of a machine for manufacturing paper, a paper web 10 is guided, via a winding roll 18, to a winding core 14. A wound roll 16, which has already been formed in FIG. 1, is wound onto winding core 14, hereinafter referred to as "old winding core" 14. Paper web 10 runs through a nip 21, which is formed between wound roll 16 and a pressure roll 32.

Rotational axes of winding roll 18 and old winding core 14, which is held in a winding carriage 44, can be arranged to lie in a same horizontal plane. Winding carriage 44 can be arranged to move old winding core 14 within the same horizontal plane and parallel to winding roll 18, i.e., in a direction tranverse to the axis of the winding roll 18, to move old winding core 14 to a discharge position so as to be discharged from the winding device.

FIG. 1 shows the winding device in a state in which a desired final diameter of wound roll 16 is achieved and old winding core 14 has been moved from its winding position next to winding roll 18 to the right.

A new winding core 12, onto which paper web 10 is to be further wound, can be moved next to winding roll 18 into a position in which a line intersecting the rotational axes of new winding core 12 and winding roll 18 extends across the horizontal plane at an angle $\alpha$ of, e.g., approximately 30°. Thus, new winding core 12 and winding roll 18 form a nip 20 for the paper web 10.

A cutting device is positioned near new winding core 12 downstream of, relative to a web travel direction, a nip 20, formed between winding roll 18 and new winding core 12, i.e., in a region between nip 20 and wound roll 16 on old winding roll 14.

The cutting device can include a knife 24 coupled with a transport device 36 that is attached to a carrier 38. Along with knife 24 and transport device 36, carrier 38 can be moved by an actuation device 34, in a direction of the double arrow, between a separating position, shown in FIG. 1 in solid lines, and a waiting position, shown in dashed lines.

Figure 2:
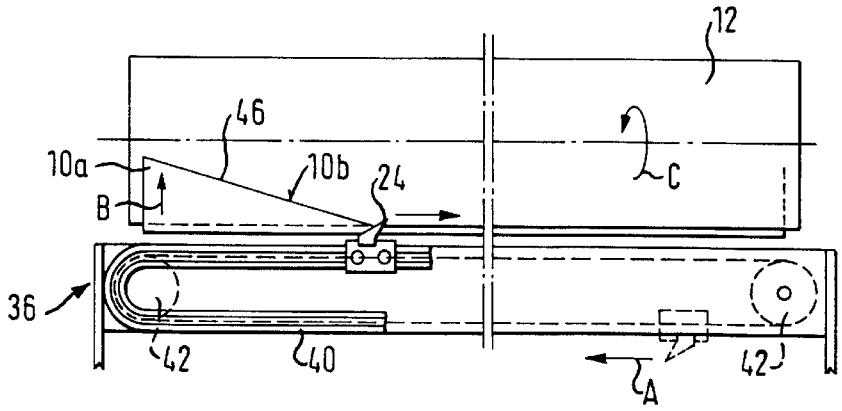
FIG. 2 illustrates a detail of the winding device depicted in FIG. 1 that is viewed in the direction of arrow II.

As illustrated in FIG. 2, transport device 36 can include a continuous element 40 embodied, e.g., as a chain, strap, or belt, to which knife 24 may be attached and which can extend across, e.g., substantially perpendicular to, web travel direction B. New winding core 12 can be rotated in a direction indicated by arrow C.

Continuous element 40 can be tensioned by two deflection rollers 42. One of the deflection rollers 42 can be coupled to a driving device (not shown) to allow continuous element 40 and, therefore, knife 24 to rotate, i.e., traverse the paper web in a cross-wise direction.

To wind paper web 10 onto new winding core 12 using the winding device according to the invention shown in FIGS. 1 and 2, the state in FIG. 1 is first achieved. For this purpose, new winding core 12 is moved between winding roll 18 and old winding core 14, which has been moved away from winding roll 18.

Subsequently or simultaneously, carrier 38 may be pivoted into the separating position shown in FIG. 1 (in solid lines) by actuation device 34 so that knife 24 is located in a rest position shown in FIG. 2 (in dashed lines) on a side of continuous element 40 that faces away from paper web 10.

When the desired diameter of winding roll 16 on old winding core 14 is achieved, continuous element 40 is set into motion in a direction of arrow A, accelerating knife 24 from its rest position so that it will reach a desired speed at least by the time it has traveled around deflection roller 42, on the left in FIG. 2. Paper web 10, which is running at an unreduced speed, may then be completely cut (separated) by knife 24, which is moving at a constant speed, e.g., between approximately 10 and 40 m/s. In this exemplary embodiment, separation of web 10 begins at its left edge.

By superposing the motion of paper web 10 and knife 24, a cutting line 46 can be formed that runs diagonally to web travel direction B. such that the angle of cutting line 46 to web travel direction B is dependent upon the relationship between the speed of knife 24 and the speed of paper web 10.

Paper web 10, which has been cut diagonally to the web travel direction B along a leading edge 10*b* of a new web end 10*a*, can be subsequently wound onto new winding core 12, if necessary, with the aid of appropriate devices. To this end, new web end 10*a* can, e.g., be blown onto new winding core 12 with pressurized air. Because of the separation of paper web 10 behind nip 20, i.e., downstream of nip 20 in relation to web travel direction B, new winding core 12 can already be partially surrounded by new web end 10*a* at the end of the separation process, which can simplify the winding of new web end 10*a* onto new winding core 12.

Instead of knife 24, the cutting device can also be provided with another cutting tool, e.g., a jet for emitting a stream of water under high pressure, a laser, or a rotating toothed cutting wheel.

In a variant of the embodiment according to FIGS. 1 and 2, the cutting device can be moved diagonally to web travel direction B, such that, as long as the speed of paper web 10 and of knife 24 remain unchanged, the angle between cutting line 46 and web travel direction B is smaller, i.e., the paper web 10 can be cut at a sharper point.

Figure 3:
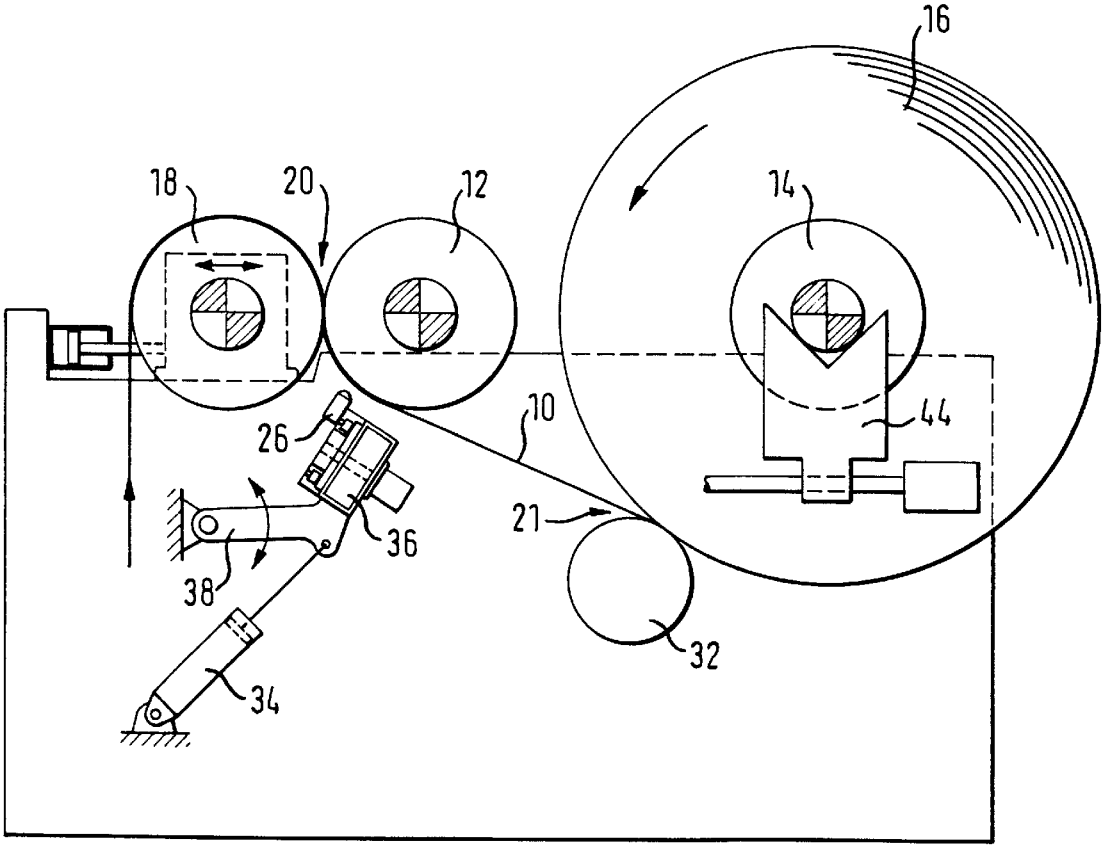
FIG. 3 illustrates a winding device according to another embodiment of the invention.

The winding device in the embodiment according to FIG. 3 differs from the embodiment according to FIGS. 1 and 2 detailed above in that, for the purpose of cutting paper web 10, new winding core 12 can be moved farther into the intermediate space between wound roll 16 and winding roll 18. In this embodiment, the rotational axes of winding cores 12 and 14 and of winding roll 18 can be positioned to lie in the same horizontal plane. Thus, in contrast to the embodiment of FIG. 1, new winding core 12 can be inserted more deeply into paper web 10 so that paper web 10 wraps around new winding roll 12 at an angle of almost 90°.

Instead of a rotating knife, the cutting device can be provided with a rotating jet 26, in which a water stream is emitted under high pressure in the direction of new winding core 12, which is in a position to cut paper web 10. Jet 26 can be formed in such a manner that a water stream is oriented or aimed in an approximately radial direction toward new winding core 12.

In principle, the cutting device can also be provided with other devices for cutting paper web 10, e.g., a laser device.

Winding cores 12 and 14 can preferably be provided with an elastically deformable coating of polyurethane or another wear-resistant plastic. Alternatively, winding roll 18 can have such a flexible coating, while winding cores 12 and 14 are provided with a coating of metal.

Figure 4:
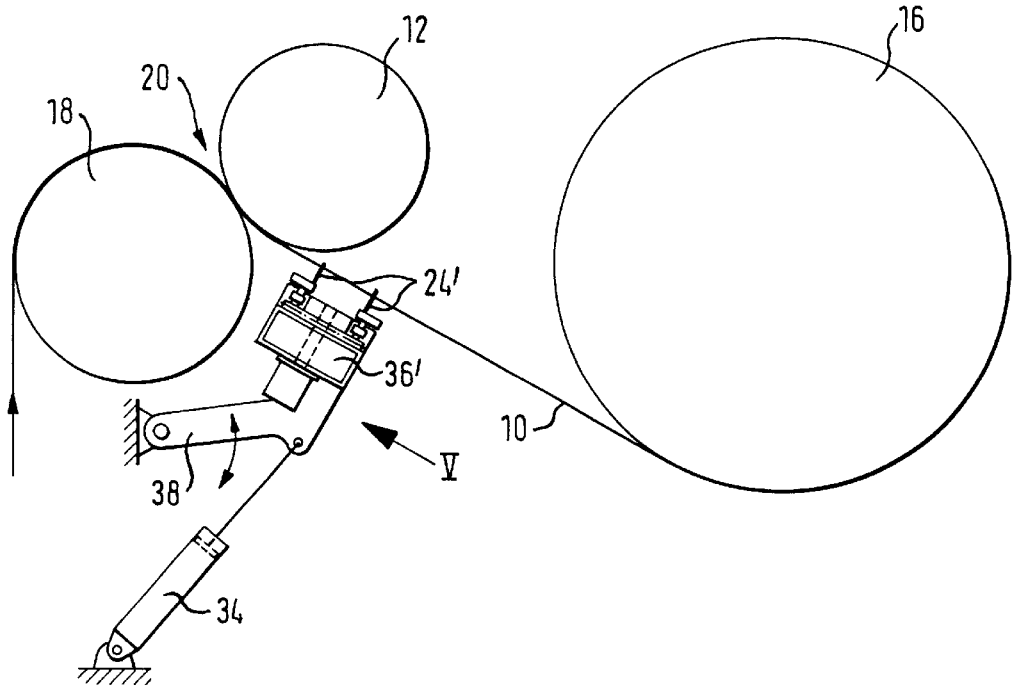
FIG. 4 illustrates a winding device according to a further embodiment of the invention.
Figure 5:
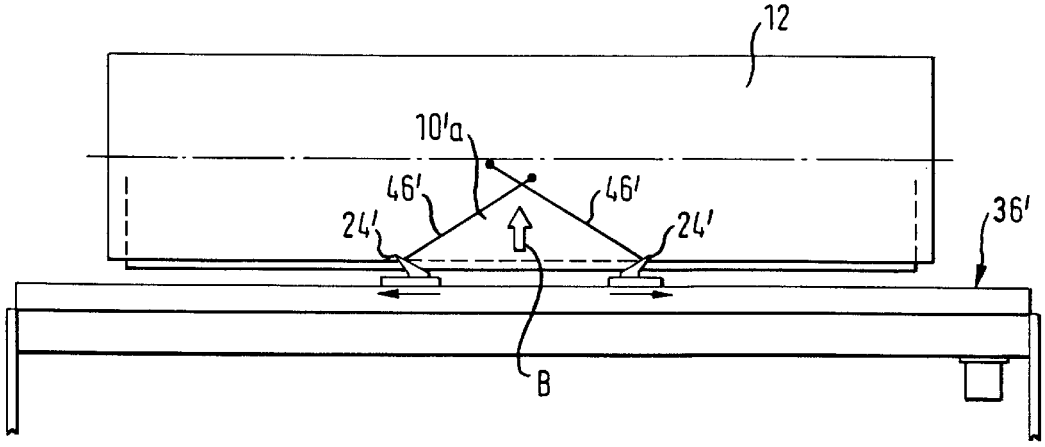
FIG. 5 illustrates a detail of the winding device depicted in FIG. 4 that is viewed in the direction of arrow V.

In the embodiment of a winding device according to the invention illustrated in FIGS. 4 and 5, in which new winding core 12 is arranged in a position relative to winding roll 18 and old winding core 14 as depicted in FIG. 1, the cutting device can include two knives 24', which move across, e.g., substantially perpendicular to, the web travel direction B shown in FIG. 5, and in opposite directions from one another.

Transport device 36' (not shown in detail in FIG. 5), includes a continuous element, which, in a manner as explained above in connection with FIGS. 1 and 2, can be attached to both knives 24'.

Knives 24' can be arranged at a distance from each other in web travel direction B and, for cutting paper web 10, may each be arranged to be approximately centered relative to its crosswise direction. In order to cut paper web 10 completely, both knives 24 are pre-accelerated and, as a function of their own speed and the speed of paper web 10, are positioned against paper web 10 so that two resulting cutting lines 46' result, as shown in FIG. 5.

Thus, a new pointed web end 10'*a* results which is wound onto the new winding core 12, if necessary, with the aid of appropriate devices, such as pressurized air.

In an alternative arrangement, knives 24' can be moved from the edges of paper web 10 in a cross-wise direction, e.g., substantially perpendicular, to web travel direction B toward the center of paper web 10 such that the cutting lines intersect near the middle of paper web 10. In this manner, a V-shaped or dovetail-shaped new web end can be formed.

Figure 6:
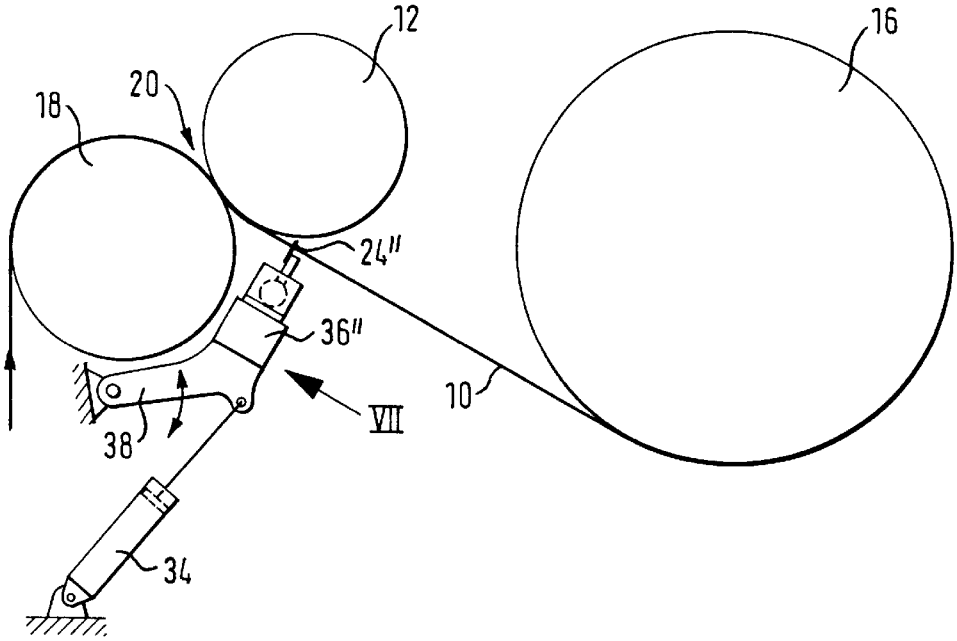
FIG. 6 illustrates a winding device according to still another embodiment of the invention.
Figure 7:
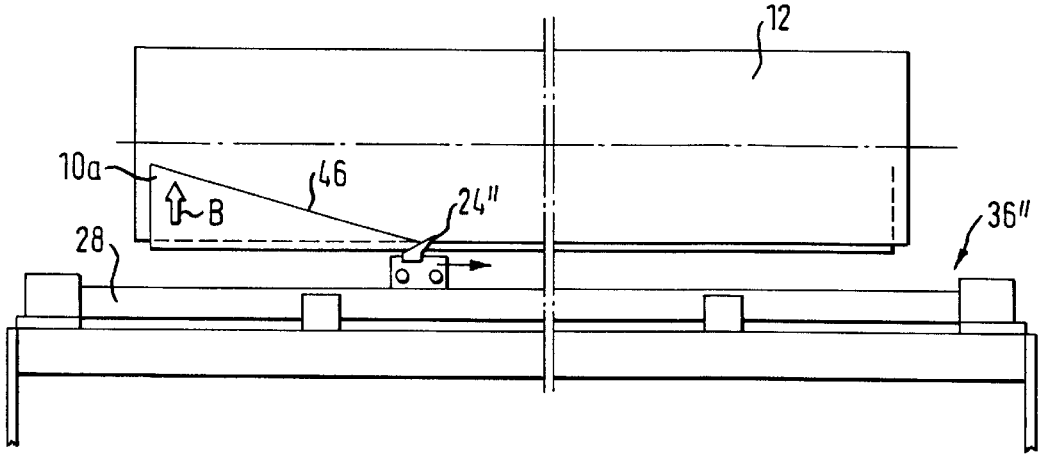
FIG. 7 illustrates a detail of the winding device depicted in FIG. 6 as viewed in the direction arrow VII.

The embodiment of the winding device according to the invention as in FIGS. 6 and 7 differs from the embodiment depicted in FIG. 1 in that transport device 36" includes a knife 24" and a cylinder piston unit 28. Knife 24" can be coupled with a piston, which is movable back and forth inside a cylinder oriented substantially perpendicular to web travel direction B.

In accordance with the present invention, it is contemplated that any of the disclosed cutting devices can be utilized in combination with any of the disclosed arrangements of the cutting devices positioned in the vicinity of new winding core 12 and between old winding core 14 and winding roll 18.

A transport device of the cutting device(s) can include a carriage guided on a linear guide mechanism. The carriage can be abruptly accelerated at the beginning of the cutting process and an be essentially shot across the entire width of paper web 10.

Transport device 36, 36' and 36" of the cutting device and actuation device 34 can be coupled to new winding core 12, e.g., via elements drawn along with new winding core 12, so that the cutting device can always be located in an optimal position for cutting paper web 10 when new winding 12 is pivoted against winding roll 18. Moreover, the optimal positioning of the cutting device can be independent of the specific position of new winding core 12 relative to winding roll 18.

A particular advantage of the present invention lies in that the pivoting movement of new winding core 12 against winding roll 18 need not be interrupted for cutting paper web 10.

Figure 8:
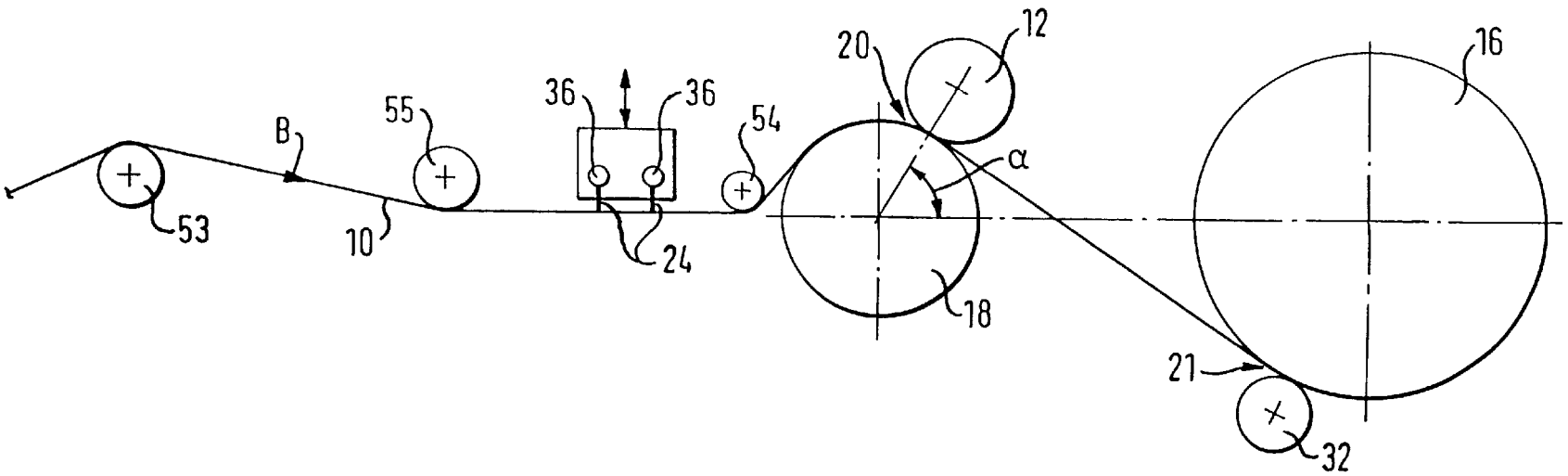
FIG. 8 illustrates a side view of a winding device according to another exemplary of the invention.

In the machine for manufacturing paper, e.g., as illustrated in FIG. 8, a paper web 10 is guided in a winding device via winding roll 18 to wound roll 16, which has already been formed on old winding core 14 (not shown). Paper web 10 is guided through nip 21 between wound roll 16 and pressure roll 32.

Rotational axes of winding roll 18 and old winding core 14, which is held in the winding carriage (not shown), can be arranged to lie in a same horizontal plane. Winding carriage 44 can be arranged to move old winding core 14 (as well as wound roll 16) within the same horizontal plane and transversely to the rotational axes.

FIG. 8 illustrates the winding device in a state in which the desired final diameter of wound roll 16 has been attained and in which old winding core is moved from its winding position next to winding roll 18 to the right.

According to FIG. 8, new winding core 12, upon which paper web 10 is to be further wound, can be moved next to winding roll 18 and into a position in which a line that intersects the rotational axes of new winding core 12 and winding roll 18 is oriented at an angle $\alpha$, e.g., approximately 30°, to the horizontal. In this manner, new winding core 12 and winding roll 18 form nip 20 for paper web 10.

The cutting device, which can include two knives 24, can be positioned upstream of a deflection roll 54, relative to web travel direction B, which is positioned upstream of winding roll 18. Each of the two knives 24 can be coupled to transport device 36 so that the knives 24 can be moved perpendicularly to web travel direction B. As indicated by the double arrow in FIG. 8, the cutting device can be moveable relative to paper web 10 to move back and forth between a rest (non-cutting) position and a cutting position. The cutting device can be attached to a carrier that can be, e.g., moved or pivoted by an actuation device between the rest position and the cutting position.

In order to wind paper web 10 onto new winding core 12, the state depicted in FIG. 8 is first attained. Thereafter, new winding core 12 can be moved between winding roll 18 and old winding core 14, which carries wound roll 16 and which has been moved away from winding roll 18.

Simultaneously or subsequently, the cutting device can be moved into the cutting position shown in FIG. 8 and knives 24 can be located in a position in which they are not yet engaged with paper web 10.

Figure 10:
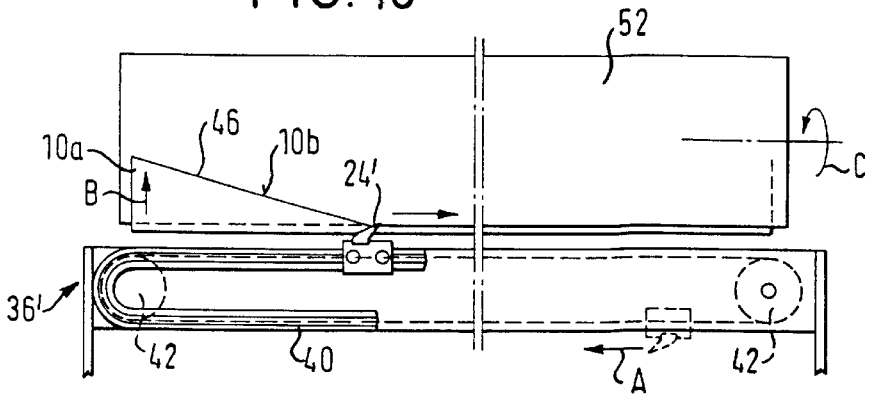
FIG. 10 illustrates the arrangement of a cutting device in a position upstream of the winding roll.
Figure 11:
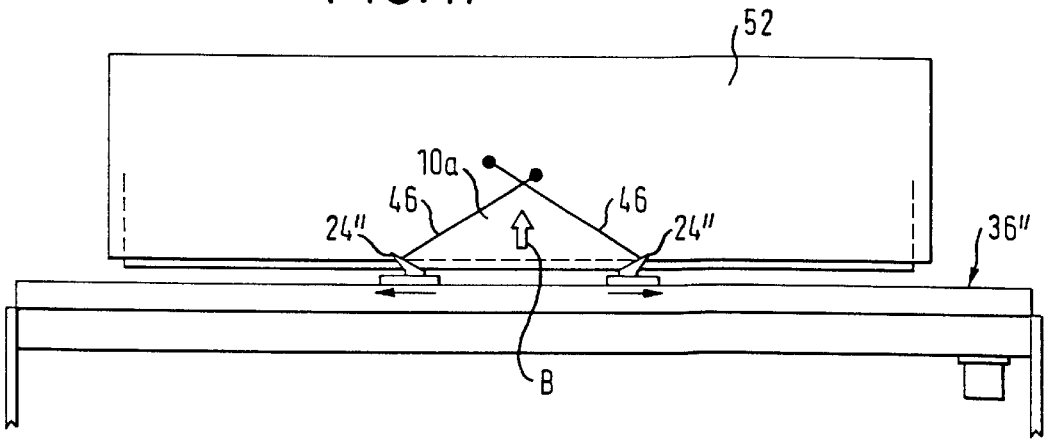
FIG. 11 illustrates an alternative arrangement of the cutting device in a position upstream of the winding roll.
Figure 12:
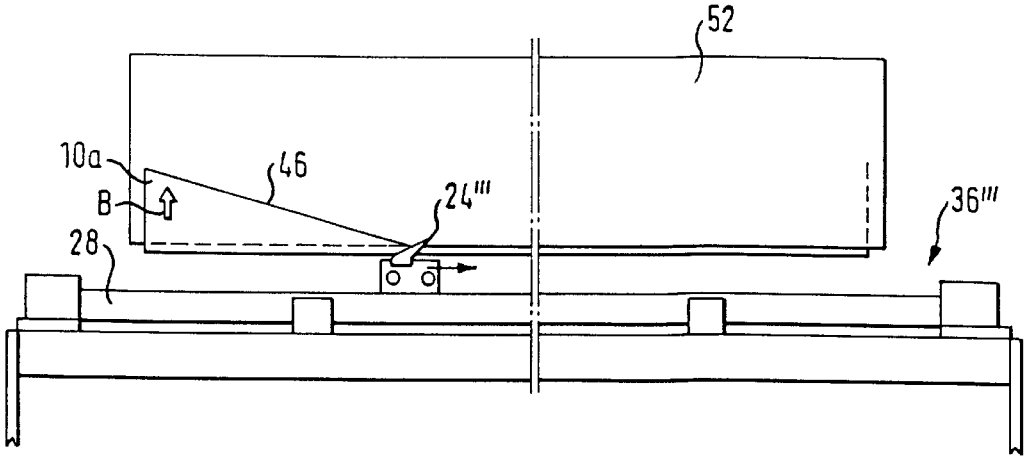
FIG. 12 illustrates another alternative arrangement of the cutting device in a position upstream of the winding roll.

Paper web can then be separated by the cutting device and thereby create a new web tail to be wound onto new winding core 12. Some exemplary configurations of structural features and functions of the cutting device are illustrated in FIGS. 10–12. However, it is noted that these examples are intended for the purpose of explanation and, therefore, are not intended to be construed as limiting the structural and functional features of the instant invention to any specific arrangements.

Figure 9:
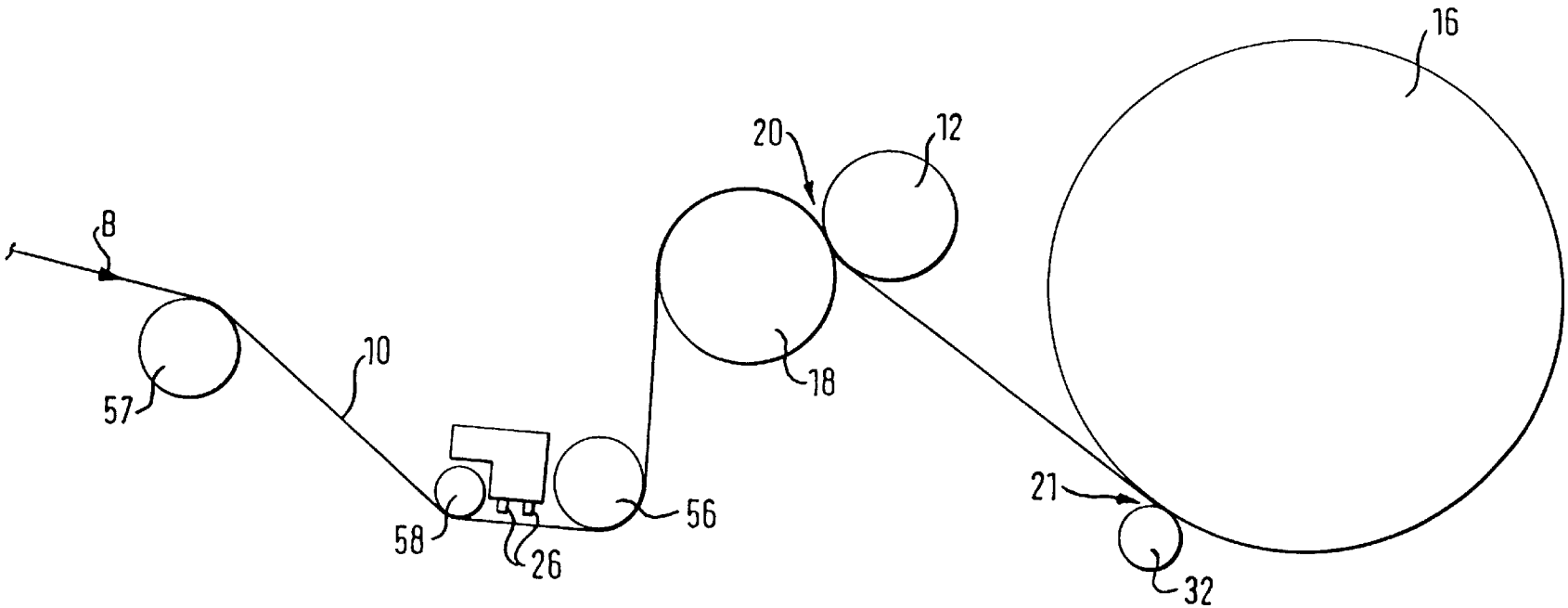
FIG. 9 illustrates a side view of a winding device according to still another exemplary embodiment of the invention.

The exemplary embodiment illustrated in FIG. 9 differs from the embodiment depicted in FIG. 8 in that a deflection roll 56 is arranged to deflect paper web 10 before or upstream of winding roll 18 in relation to web travel direction B. A rotational axis of deflection roll 56 can be located underneath the horizontal plane formed by the rotational axes of winding roll 18 and wound roll 16, and deflection roll 56 can be positioned to deflect paper web 10 to run in a somewhat vertical direction before being guided onto winding roll 18.

In FIG. 9, the cutting device, which may be arranged immediately before deflection roll 56 in web travel direction B, can include cutting devices formed by, e.g., two jets 26 of a stream of fluid, such as a stream of water. Jets 26 can be squirted out under high pressure and positioned to separate or cut paper web 10. Jets 26 may be formed such that the streams of water are oriented to strike the plane defined by paper web 10 in an at least approximately perpendicular manner. In principle, however, the streams can be oriented to diagonally strike the surface of paper web 10.

Deflection roll 56 and the cutting device can be arranged inside a paper making machine, e.g., near the floor.

Like the cutting device depicted in FIG. 8, the cutting device shown in FIG. 9, which includes jets 26, can be formed as pivotable or moveable between a rest position and a cutting position. However, this mobility of the cutting device is not absolutely necessary because the fluid and/or water supply to jets 26 of the cutting device can be interrupted with an appropriate regulation and/or control element.

In the exemplary embodiments according to FIGS. 8 and 9, paper web 10 can be separated or cut with the cutting device in the region of a free running path. In principle, it is possible to position the cutting device so that paper web 10 can be separated or cut in a region in which paper web 10 is in contact with (i.e., touching) a roll arranged upstream of winding roll 18, e.g., one of rolls 53, 54, and 55 and/or 56, 57, and 58.

FIGS. 10–12 depict exemplary embodiments of the cutting devices discussed above with regard to FIGS. 8 and 9 for separating paper web 10. The cutting devices can include one or two knives, or other cutting devices or tools, e.g., jets for emitting a high-pressure stream of water, laser devices, or rotating toothed cutting wheels.

The cutting device shown in FIG. 10 includes a single knife 24, and substantially corresponds to the arrangement shown in FIG. 2. Transport device 36 for knife 24 includes a continuous element 40 embodied as, e.g., a chain, strap, or belt, to which knife 24 can be attached and which can extend across, e.g., substantially perpendicular, to web travel direction B, i.e., lengthwise along a roll 52. Roll 52 is shown having a rotational direction C.

Roll 52 can be, e.g., one of the deflection roll depicted in FIGS. 8 and 9 that is arranged upstream of winding roll 18, e.g., deflection roll 54 and/or deflection roll 56. However, in accordance with the features of the present invention, it is also possible to provide the cutting device at a greater distance from the rolls.

Continuous element 40 can be tensioned between two deflection rollers 42. One of the deflection rollers 42 can be coupled to a driving device (not shown) to allow continuous element 40 and, therefore, knife 24 to rotate in a loop.

After the desired diameter of wound roll 16 is attained, and a distance between winding roll 18 and wound roll 16 is effected, e.g., as shown in FIGS. 8 and 9, continuous element 40 can be set into motion in the direction of an arrow A, causing knife 24 (or other cutting device or tool) to be accelerated from its rest position to a desired speed by, at the latest, the time the knife rotates around the left deflection roll 42 shown in FIG. 10. In this manner, paper web 10, which is running at an undiminished speed, is completely cut by knife 24, which runs crosswise to web travel direction B at a constant speed, e.g., preferably between 10 and 40 m/s, beginning at the left edge as shown in FIG. 10.

The combined movement of paper web 10 and knife 24 creates a cut line 46 that runs diagonally to web travel direction B. As discussed above, the diagonal of cut line 46 is dependent upon the relative speeds of knife 24 and paper web 10.

Paper web 10, which has been cut diagonally to web travel direction B along a leading edge 10*b* of new web tail 10*a*, can be subsequently wound onto new winding core 12, if necessary, with the aid of appropriate devices. To this end, new web end 10*a* can, e.g., be guided via roll 52, through nip 20 formed between winding roll 18 and new winding core 12. Moreover, if necessary, additional elements can be utilized to assist with winding new web end 10*a* onto new winding core 12. New web tail 10*a* can also be, e.g., blown onto new winding core 12 with an application of pressurized air.

In a variant of the exemplary embodiment depicted in FIG. 10, the cutting device can also be moved diagonally to web travel direction B, such that, if the speed of paper web 10 and knife 24 remains constant, paper web 10, and more particularly the angle between cut line 46 and web travel direction B can be cut at a sharper point.

The cutting device depicted in FIG. 11 includes two knives 24', which are moveable in opposite directions substantially perpendicular to web travel direction B, and which are arranged to correspond to FIG. 5, discussed above.

Transport device 36', which is not shown in detail in FIG. 11, can include a continuous device, similar in general to continuous device 40, discussed above, and to which both knives 24' (or cutting devices or tools) can be attached.

Both knives 24' can be arranged at a distance from one another in relation to web travel direction B and can be placed somewhat toward a center of paper web 10 in relation to the crosswise direction. To cut paper web 10 completely, both knives 24' can be pre-accelerated and, depending upon their own speed and the speed of paper web 10, can be moved toward the surface of paper web 10 so as to form the two cut lines shown in FIG. 11.

In this manner, a pointed new web tail 10*a* is formed that, as described in connection with FIG. 10 above, is guided toward new winding core 12 to be wound onto new winding core 12. If necessary, other devices can be utilized to facilitate the guiding of new web tail 10*a* onto new winding core 12.

In an alternative arrangement, cut lines can be formed by knives 24' which are moved substantially perpendicular to web travel direction B from each edge of paper web 10 toward the center of paper web 10. In this manner, a V-shaped or dovetail-shaped new web tail can be formed.

In the exemplary embodiment of a cutting device depicted in FIG. 12, a knife 24" can be coupled to a moveable a transport device 36" that includes a cylinder-piston unit 28. Knife 24" can be coupled to the piston to be moved back and forth within the cylinder, which extends substantially perpendicularly to the web travel direction B and parallel to paper web 10.

In principle, it is contemplated that any combination of the disclosed cutting devices can be utilized in combination with any of the disclosed arrangements depicted in FIGS. 8 and 9 in the paper making machine in which the cutting device is located upstream of winding roll 18.

A transport device for the cutting device(s) can include a carriage that is guided on a linear guide mechanism. The carriage can be abruptly accelerated at the beginning of the cutting process and, to a certain extent, can be shot across the entire width of paper web 10.

In accordance with the features of the instant invention, it is noted that movement of new winding core 12 toward winding roll 18 need not be interrupted to cut paper web 10.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Material web, paper web
10*a*, 10'*a* New web end

10*b* Leading edge
12 New winding core
14 Old winding core
16 Wound roll
18 Winding roll
20, 21 Nip
24, 24', 24" Knife
26 Jet
28 Cylinder piston unit
32 Pressure roll
34 Actuation device
36, 36', 36" Transport device
38 Carrier
40 Continuous element
42, 52, 53, 54, 56, 57, 58 Deflection rollers
44 Winding carriage
46, 46' Cutting lines
A Direction of travel of the knife
B Direction of travel of the material web and/or paper web
C Rotational direction of the new winding core

What is claimed:

1. A process for cutting a running material web in which the material web is wound onto several winding cores in succession, such that winding of the material web onto a new winding core begins after a predetermined diameter has been attained in a wound roll formed on an old winding core, the process comprising:

moving the new winding core between a winding roll and the wound roll, wherein the material web is fed onto the wound roll from the winding roll;

forming a nip between the new winding core and the winding roll;

positioning at least one cutting device one of in a region between the wound roll and the nip and in a region upstream of the winding roll relative to a web run direction; and moving the at least one cutting device, which is movably mounted on a transport device via at least one of a continuous element and a piston/cylinder unit, relative to the material web in a plane substantially parallel to the material web, whereby the running material web is completely cut.

2. The process in accordance with claim 1, the moving of the at least one cutting device comprising moving the at least one cutting device across a web travel direction, whereby a diagonal cutting line results.

3. The process in accordance with claim 2, wherein the at least one cutting device is moved substantially perpendicular to the web travel direction.

4. The process in accordance with claim 1, the moving of the at least one cutting device comprising moving the at least one cutting device diagonally to a web travel direction.

5. The process in accordance with claim 4, wherein the diagonal movement includes a component parallel to and opposite the web travel direction.

6. The process in accordance with claim 4, wherein the diagonal movement includes a component parallel to and in the web travel direction.

7. The process in accordance with claim 1, the moving of the at least one cutting device comprising moving the at least one cutting device continuously across an entire width of the material web.

8. The process in accordance with claim 1, the moving of the at least one cutting device comprising moving the at least one cutting device at an at least approximately constant speed.

9. The process in accordance with claim 8, wherein the at least approximately constant speed is between approximately 10 and 40 m/s.

10. The process in accordance with claim 1, further comprising accelerating the cutting device before cutting the material web.

11. The process in accordance with claim 1, wherein the at least one cutting device includes at least one of a knife, a rotating toothed cutting wheel, a laser, and a jet emitting a stream of water.

12. The process in accordance with claim 1, wherein the at least one cutting device includes at least two cutting devices, and the process further comprises moving the at least two cutting devices in opposite directions across a web travel direction at an at least approximately constant speed.

13. The process in accordance with claim 12, wherein the at least two cutting devices are moved substantially perpendicular to the web travel direction.

14. The process in accordance with claim 12, wherein the at least two cutting devices are located in a position separated in the web travel direction, and each of the at least two cutting devices are approximately centered relative to a crosswise direction.

15. The process in accordance with claim 12, further comprising moving the at least two cuffing devices from respective edges of the material web toward a middle of the web.

16. The process in accordance with claim 12, further comprising moving the at least two cutting devices from a middle of the material web toward respective edges of the web.

17. The process in accordance with claim 1, wherein the at least one cutting device comprises at least two cutting devices, and the process further comprises moving the at least two cutting devices relative to the material web in a plane that is substantially parallel to the material web.

18. The process in accordance with claim 1, wherein the cutting the material web occurs in a region of a free draw between the new winding core and the wound roll.

19. The process in accordance with claim 1, wherein the cutting the material web occurs in a region in contact with the new winding core.

20. The process in accordance with claim 1, wherein, during the cutting of the material web, the rotational axis of the new winding core lies above a horizontal plane containing the rotational axis of the old winding core.

21. The process in accordance with claim 1, wherein, during the cutting of the material web, the rotational axis of the new winding core lies essentially in a horizontal plane containing the rotational axis of the old winding core.

22. The process in accordance with claim 1, wherein the cutting forms a new web end, and the process further comprises applying the new web end to the new winding core.

23. The process in accordance with claim 22, wherein the applying of the new web end to the new winding core comprises at least one of blowing, moistening, gluing, and providing strips of adhesive.

24. The process in accordance with claim 1, wherein a travel speed of the material web is not reduced during the cutting of the material web.

25. The process in accordance with claim 1, wherein the new winding core is inserted into the material web when the new winding core is moved between the winding roll and the wound roll.

26. The process in accordance with claim 1, wherein the material web comprising a paper web, wherein the winding cores are composed of reel spools, and wherein the winding roll is composed of a king roll.

27. The process in accordance with claim 1, the moving of the at least one cutting device comprising moving the at least one cutting device across a web travel direction, whereby a diagonal cutting line results; and the moving of the at least one cutting device comprising moving the at least one cutting device at an at least approximately constant speed, wherein the at least one cutting device includes at least one of a knife, a rotating toothed cutting wheel, a laser, and a jet emitting a stream of water.

28. The process in accordance with claim 27, wherein the at least one cutting device includes at least two cutting devices and the process further comprises moving the at least two cutting devices in opposite directions during the cutting of the material web.

29. The process in accordance with claim 1, wherein the cutting the paper web occurs in a free run region between the wound roll and the new winding core.

30. The process in accordance with claim 1, wherein the cutting the paper web occurs in a region between the wound roll and the nip.

31. The process in accordance with claim 1, wherein the cutting the paper web occurs in a region upstream from the winding roll.

32. The process in accordance with claim 31, wherein the cutting the paper web occurs while the paper web is in contact with a roll positioned upstream from the winding roll.

33. An apparatus for cutting a running material web in which the material web is wound onto several winding cores in succession, the apparatus comprising:

at least one cutting device structured and arranged to completely cut the material web;

a movable transport device; and said at least one cutting device being movably mounted on said movable transport device via at least one of a continuous element and a piston/cylinder unit for movement relative to the material web in a plane substantially parallel to the material web.

34. The apparatus in accordance with claim 33, wherein said at least one cutting device is mounted for movement across an entire width of the material web.

35. The apparatus in accordance with claim 33, said continuous element being arranged to wrap around deflection rolls; and said continuous element being coupled, on an outer side, to said at least one cutting device.

36. The apparatus in accordance with claim 35, said continuous element comprising one of a chain and strap.

37. The apparatus in accordance with claim 33, further comprising:

an old winding core on which a wound roll is being wound;

a new winding core on which a next wound roll will be wound; and said winding cores comprising an elastically deformable covering composed of a wear-resistant plastic.

38. The apparatus in accordance with claim 37, wherein said wear-resistant plastic comprises polyurethane.

39. The apparatus in accordance with claim 33, wherein said at least one cutting device is mounted for movement across a width of the material web, and wherein said at least one cutting device comprises a jet adapted to direct a water stream at a new winding core.

40. The apparatus in accordance with claim 33, said at least one cutting device comprising at least two cutting devices;

said at least two cutting devices being separated in the web travel direction and being mounted for movement in opposite directions across the web travel direction.

41. The apparatus in accordance with claim 40, said at least two cutting devices being mounted for movement substantially perpendicular to the web travel direction.

42. The apparatus in accordance with claim 33, said at least one cutting device comprising at least two cutting devices;

said at least two cutting devices being mounted for movement relative to the material web in a plane substantially parallel to the material web.

43. The apparatus in accordance with claim 42, wherein each of said at least two cutting devices is composed of at least one of a knife, a water jet, a laser, and a rotating toothed cutting wheel.

44. The apparatus in accordance with claim 33, said at least one cutting device comprising at least two cutting devices;

said at least two cutting devices being mounted for movement in opposite directions.

45. The apparatus in accordance with claim 44, said at least two cutting devices being mounted for movement from respective edges of the material web to a middle of the material web.

46. The apparatus in accordance with claim 44, said at least two cutting devices being mounted for movement from a middle of the material web to respective edges of the material web.

47. The apparatus in accordance with claim 33, said at least one cutting device being mounted for movement across a web travel direction, whereby a diagonal cutting line results; and said at least one cutting device comprising at least one of a knife, a rotating toothed cutting wheel, a laser, and a jet emitting a stream of water, wherein said at least one cutting device is mounted for movement at an at least approximately constant speed.

48. The apparatus in accordance with claim 47, said at least one cutting device comprising at least two cutting devices mounted for movement in opposite directions during the cutting of the material web.

49. The apparatus in accordance with claim 33, further comprising:

an old winding core on which a wound roll is being wound; and a new winding core on which a next wound roll will be wound, wherein said cutting device is arranged between said old winding core and said new winding core.

50. The apparatus in accordance with claim 33, further comprising:

an old winding core on which a wound roll is being wound; and a new winding core on which a next wound roll will be wound, wherein said cutting device is arranged upstream, relative to a web run direction, from said new winding core.

51. The apparatus in accordance with claim 50, further comprising at least one deflection roll located upstream from said new winding core.

52. The apparatus in accordance with claim 33, wherein the cutting device comprises a fluid jet.

53. The apparatus in accordance with claim 52, wherein said fluid jet comprises a stream of water.

54. An apparatus for cutting a running material web in which the material web is wound onto several winding cores in succession, the apparatus comprising:

at least one cutting device adapted to completely cut the material web;

said at least one cutting device being mounted for movement relative to the material web in a plane substantially parallel to the material web;

a transport device having at least one cylinder/piston unit; and said piston being coupled, on one end, to said at least one cutting device.

55. An apparatus for cutting a running material web in which the material web is wound onto several winding cores in succession, the apparatus comprising:

at least one cutting device adapted to completely cut the material web;

said at least one cutting device being mounted for movement relative to the material web in a plane substantially parallel to the material web;

an old winding core on which a wound roll is being wound;

a new winding core on which a next wound roll will be wound; and a winding roll, wherein said at least one cutting device is located between said new winding core and said wound roll.

56. The apparatus in accordance with claim 55, said winding cores comprising a covering made of metal; and said winding roll comprising a covering composed of an elastically deformable wear-resistant plastic.

57. The apparatus in accordance with claim 56, wherein said wear-resistant plastic comprising polyurethane.

58. An apparatus for cutting a running material web in which the material web is wound onto several winding cores in succession, the apparatus comprising:

at least one cutting device adapted to completely cut the material web;

said at least one cutting device being mounted for movement relative to the material web in a plane substantially parallel to the material web;

an old winding core on which a wound roll is being wound;

a new winding core on which a next wound roll will be wound; and at least one deflection roll located upstream from said new winding core, wherein said cutting device is arranged upstream from said at least one deflection roll.

59. A process for cutting a running material web in which the material web is wound onto several winding cores in succession, such that winding of the material web onto a new winding core begins after a predetermined diameter has been attained in a wound roll formed on an old winding core, the process comprising:

moving the new winding core between a winding roll and the wound roll, wherein the material web is fed onto the wound roll from the winding roll;

forming a nip between the new winding core and the winding roll;

positioning at least one cutting device one of in a vicinity of the winding roll; and moving the at least one cutting device, which is movably mounted on a transport device via at least one of a continuous element and a piston/cylinder unit, relative to the material web in a plane substantially parallel to the material web, whereby the running material web is completely cut.

* * * * *